US006868685B2

(12) United States Patent
Kim

(10) Patent No.: US 6,868,685 B2
(45) Date of Patent: Mar. 22, 2005

(54) AIR CONDITIONER AND METHOD OF CONTROLLING THE SAME

(75) Inventor: Jong-Youb Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 251 days.

(21) Appl. No.: 10/240,667

(22) PCT Filed: Jan. 29, 2002

(86) PCT No.: PCT/KR01/01758

§ 371 (c)(1),
(2), (4) Date: Dec. 4, 2002

(87) PCT Pub. No.: WO02/066902

PCT Pub. Date: Aug. 29, 2002

(65) Prior Publication Data

US 2004/0093881 A1 May 20, 2004

(30) Foreign Application Priority Data

Feb. 16, 2001 (KR) ..... 2001-7736
Jun. 1, 2001 (KR) ..... 2001-30830

(51) Int. Cl.[7] ..... F25B 1/00; F25B 49/00
(52) U.S. Cl. ..... 62/228.1; 165/269; 62/228.5
(58) Field of Search ..... 62/228.1, 228.5, 62/230, 157; 417/12, 290; 165/269

(56) References Cited

U.S. PATENT DOCUMENTS 4,292,813 A * 10/1981 Paddock ..... 62/158
4,401,149 A * 8/1983 Iijima et al. ..... 165/122
4,540,040 A * 9/1985 Fukumoto et al. ..... 165/202
5,022,234 A * 6/1991 Goubeaux et al. ..... 62/228.5
6,047,557 A 4/2000 Pham et al.
6,601,397 B2 * 8/2003 Pham et al. ..... 62/181
6,745,584 B2 * 6/2004 Pham et al. ..... 62/228.3
2001/0049942 A1 * 12/2001 Pham et al. ..... 62/126

FOREIGN PATENT DOCUMENTS

KR 99-75671 10/1999
KR 00-20087 4/2000

* cited by examiner

*Primary Examiner*—Marc Norman
(74) *Attorney, Agent, or Firm*—Staas & Halsey LLP

(57) ABSTRACT

Disclosed herein is an air conditioner and method of controlling the same. The air conditioner includes a compressor having a capacity variable according to a duty control signal. The duty control signal controls the compressor to undergo a loading time for maintaining a loading state in a cycle and an unloading time for maintaining an unloading state in a cycle. The air conditioner further includes a control unit for determining the loading time and the unloading time according to the variation of a total required cooling capacity to generate the duty control signal even before a corresponding cycle is over, if the total required cooling capacity has been varied in a corresponding cycle while the compressor is operated, and controlling the compressor according to the duty control signal.

19 Claims, 14 Drawing Sheets

AIR CONDITIONER AND METHOD OF CONTROLLING THE SAME

TECHNICAL FIELD

The present invention relates generally to an air conditioner and method of controlling the same, and more particularly to an air conditioner employing a pulse width modulated compressor and method of controlling the same.

BACKGROUND ART

Recently, as buildings have become large-sized, demand for multi-air conditioners, in which an outdoor unit is connected to a plurality of indoor units, has been increased. In general, the individual indoor units of such a multi-air conditioner have different required cooling capacities and each of the indoor units is independently operated, such that the total cooling capacity obtained by summing up the required cooling capacities of all the indoor units is varied. Accordingly, in order to meet the variation of the total required cooling capacity, the capacity of a compressor is adjusted according to the variation of the total required cooling capacity, and the opening ratio of an electric expansion valve situated upstream of an indoor heat exchanger or evaporator is controlled for each of the indoor units.

As a compressor having a capacity to be varied according to the variation of a required cooling capacity, a variable-speed compressor is known. Such a variable-speed compressor adjusts the capacity of the compressor according to the variation of the required cooling capacity by varying the frequency of a current applied to a motor through an inverter control method and thus controlling the rotational speed of the motor. The conventional variable-speed compressor requires a circuit for controlling the speed of the motor according to the required cooling capacity. The control circuit has a converting unit for converting an AC power voltage into a DC power voltage, and an inverting unit for inverting a DC power voltage into an AC power voltage.

However, the conventional variable-speed compressor is disadvantageous in that its efficiency is deteriorated due to a significant loss of energy in the control circuit.

A Pulse Width Modulated (PWM) compressor is disclosed as another type of variable-capacity compressor in U.S. Pat. No. 6,047,557 and Japanese Patent Laid-open Publication No. 8-334094. The PWM compressor is effectively used in a refrigeration system having a plurality of refrigeration compartments or freezing compartments, but it is not equally applied to an air-conditioning system for buildings, which has a different control environment from the refrigeration system.

FIG. 8*a* is a view showing the control operation and suction pressure of a conventional compressor when a total required cooling capacity has been decreased in the unloading state of the compressor, and FIG. 8*b* is a view showing the control operation and suction pressure of the conventional compressor when a total required cooling capacity has been decreased in the loading state of the compressor.

Referring to FIG. 8*a*, when a total required cooling capacity has been decreased in a unloading state (a state of not discharging refrigerant, wherein a PWM valve is turned on) of a corresponding cycle (Nth cycle) (Ta), the amount of the refrigerant sucked into the compressor from an indoor units is decreased. However, the loading time (A) of the compressor is kept the same in the corresponding cycle (Nth cycle), so the compressor discharges more refrigerant than an actually required amount of refrigerant. Referring to FIG. 8*b*, when a total required cooling capacity has been decreased in a loading state (a state of discharging refrigerant, wherein the PWM valve is turned off) of a corresponding cycle (Nth cycle), the loading time (A) of the compressor is kept the same in the corresponding cycle (Nth cycle). Therefore, the compressor discharges more refrigerant than an actually required amount of refrigerant. Accordingly, the suction pressure of the compressor is decreased excessively in the corresponding cycle (Nth cycle) (refer to "D" in FIG. 8*b*).

Hence, in the prior art, even though the actually required cooling capacity is decreased in the corresponding cycle, the capacity of the compressor is not adjusted in the corresponding cycle. After the corresponding cycle is over, the capacity of the compressor is varied to correspond to the varied required cooling capacity.

As described above, if the air conditioner employs the PWM compressor, a loading time when refrigerant is discharged and an unloading time when refrigerant is not discharged are cyclically repeated during the operation of the compressor, such that the flow of the refrigerant occurs periodically in a cycle. Hence, if the capacity of the compressor is not swiftly adjusted to meet the total required cooling capacity, the suction pressure of the compressor may be rapidly decreased or increased, thus incurring damage to the compressor and causing the stoppage of the compressor operation.

Moreover, in spite of a decreased total required cooling capacity, if the compressor discharges excessive refrigerant, the indoor heat exchangers are apt to be overcooled or even frozen. So, the indoor units are obliged to operate periodically for preventing the respective indoor heat exchangers from being overcooled.

DISCLOSURE OF THE INVENTION

Accordingly, the present invention has been made in view of the above problem, and it is an object of the present invention to provide an air conditioner and method of controlling the same, which is capable of promptly controlling a compressor according to the required cooling capacity rapidly varied while a PWM compressor is operated.

In accordance with one aspect of the present invention, the above and other objects can be accomplished by the provision of an air conditioner, comprising a compressor having a capacity variable according to a duty control signal, the duty control signal controlling the compressor to undergo a loading time for maintaining a loading state in a cycle and an unloading time for maintaining an unloading state in a cycle; and a control unit for determining the loading time and the unloading time according to the variation of a total required cooling capacity to generate the duty control signal even before a corresponding cycle is over, when the total required cooling capacity has been varied in a corresponding cycle while the compressor is operated, and controlling the compressor according to the duty control signal.

In accordance with another aspect of the present invention, there is provided a method of controlling an air conditioner including a compressor with a capacity varied according to a duty control signal having a loading time and an unloading time in a corresponding cycle, comprising the steps of a) operating the compressor; b) determining whether a total required cooling capacity has been varied; and c) determining a loading time and an unloading time according to the variation of the total required cooling capacity to generate a duty control signal even before a corresponding cycle is over, when the total required cooling capacity has been varied in a corresponding cycle, and controlling the compressor according to the duty control signal.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
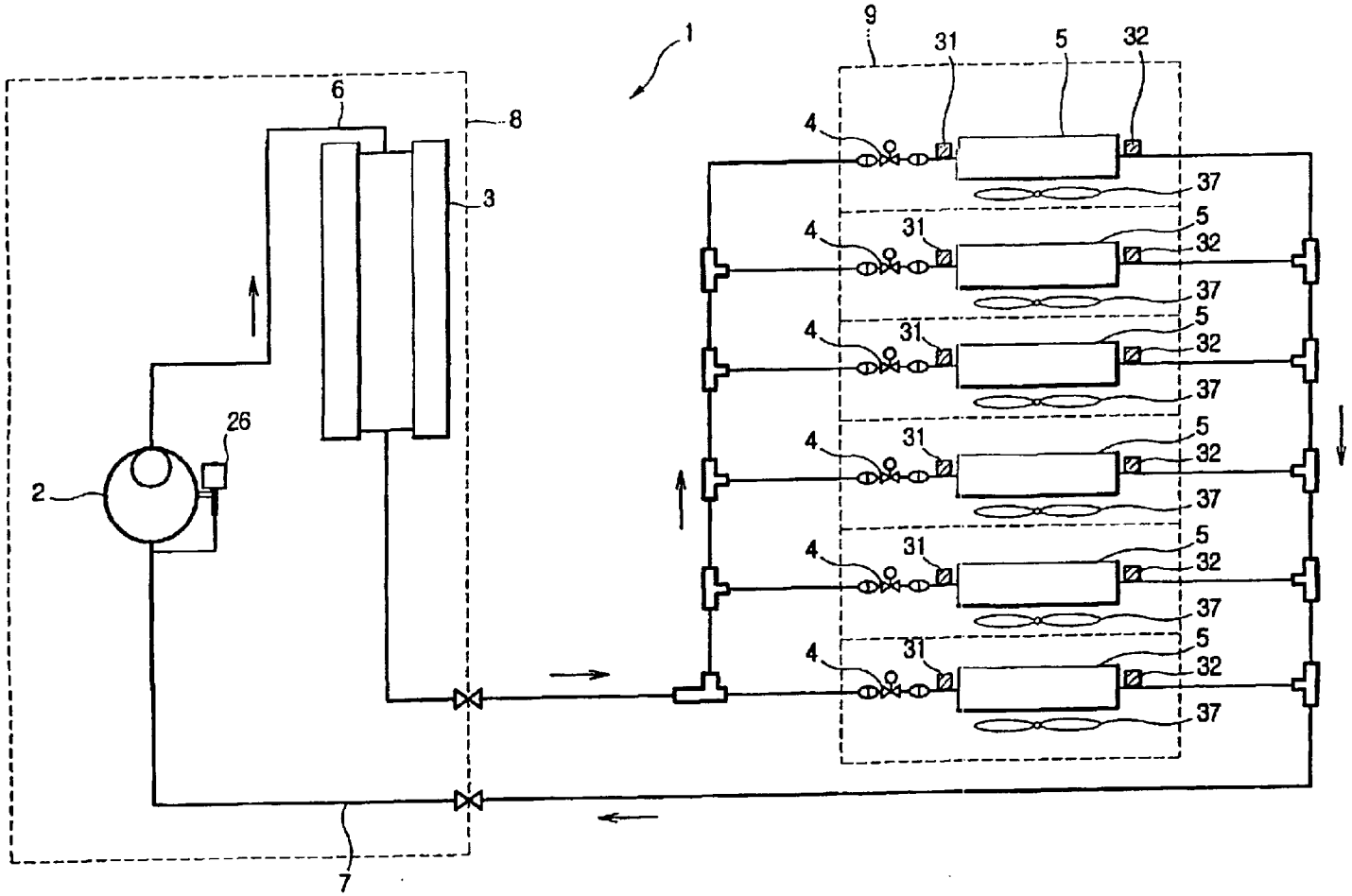
FIG. 1 is a view showing an air-conditioning cycle of an air conditioner in accordance with the present invention.

FIG. 1 is a view showing an air-conditioning cycle of an air conditioner according to the present invention. The air conditioner 1 of this invention comprises a compressor 2, a condenser 3, a plurality of electric expansion valves 4, and a plurality of evaporators 5, which are sequentially connected to each other through refrigerant piping so as to form a closed circuit. A refrigerant pipe of the refrigerant piping for connecting the discharge end of the compressor 2 to the inflow ends of the electric expansion valves 4 is a high pressure pipe 6 for guiding the flow of high pressure refrigerant discharged by the compressor 2. A refrigerant pipe for connecting the outflow ends of the electric expansion valves 4 to the suction end of the compressor 2 is a low pressure pipe 7 for guiding the flow of low pressure refrigerant expanded by one or more electric expansion valves 4. The condenser 3 is installed in the middle of the high pressure pipe 6, and the evaporator 5 is installed in the middle of the low pressure pipe 7. When the compressor 2 operates, the refrigerant flows in the direction of the solid arrows shown in FIG. 1.

The air conditioner 1 of this invention comprises an outdoor unit 8 and a group of indoor units 9. The outdoor unit 8 includes the compressor 2 and the condenser 5, and the indoor unit group 9 is comprised of a plurality of indoor units arranged in parallel with each other. Each indoor unit of the indoor unit group 9 has one electric expansion valve 4 and one evaporator 5. Therefore, the air conditioner 1 has a construction in which a plurality of indoor units are commonly connected to one outdoor unit 8. The capacities and types of the indoor units may be identical or different.

In the meantime, an evaporator-inlet temperature sensor 31 for measuring the temperature of refrigerant flowing into the evaporator 5 is installed in the inlet of the evaporator 5. An evaporator-outlet temperature sensor 32 for measuring the temperature of refrigerant flowing out of the evaporator 5 is installed in the outlet of the evaporator 5. The temperature sensors 31 and 32 are means for measuring the degree of overheating of the refrigerant.

Each of the indoor units has an indoor fan 37 situated near the evaporator 5. The indoor fan 37 allows indoor air to pass through the evaporator 5, so that the heat exchange is performed by the evaporator 5.

Figure 2A:
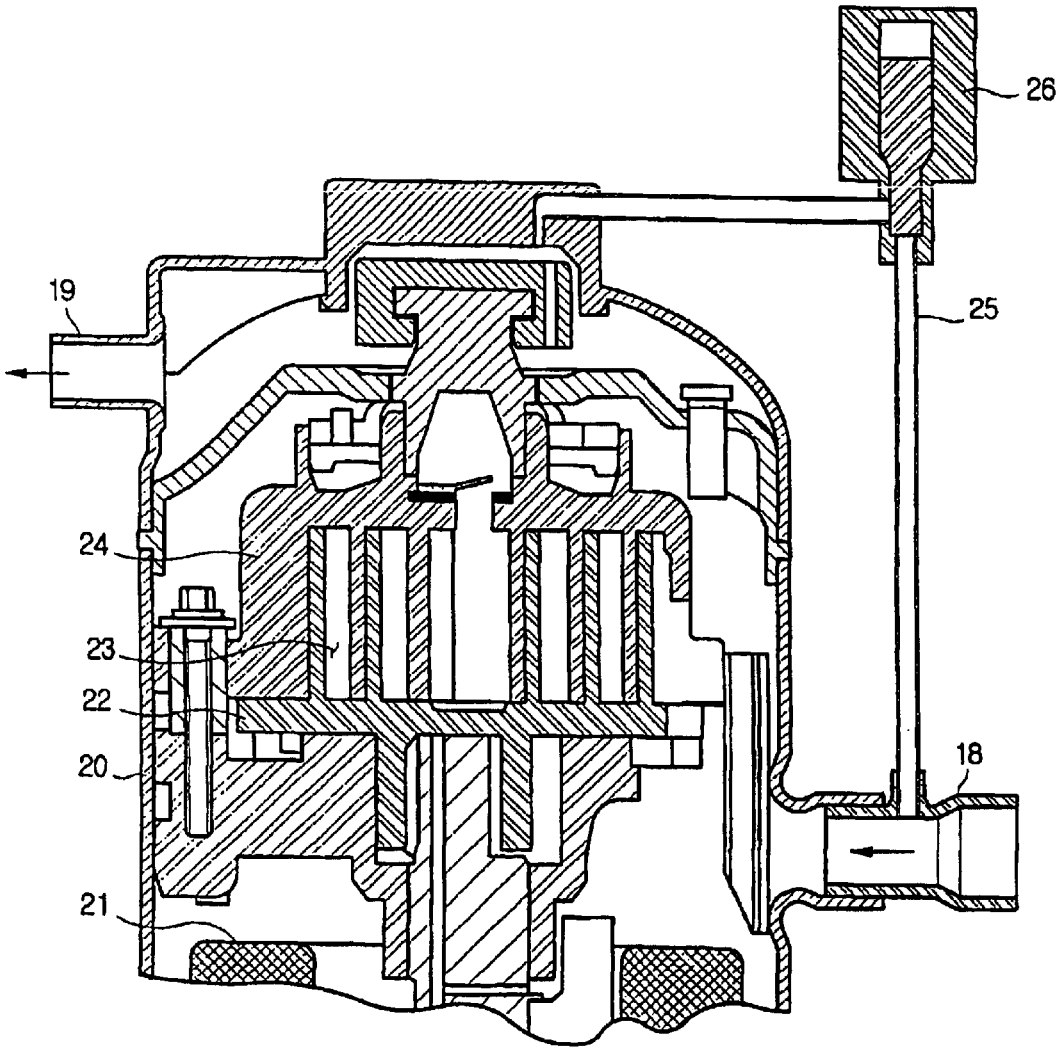
FIG. 2*a* is a view showing the loading position of a PWM compressor employed in the air conditioner of the present invention.
Figure 2B:
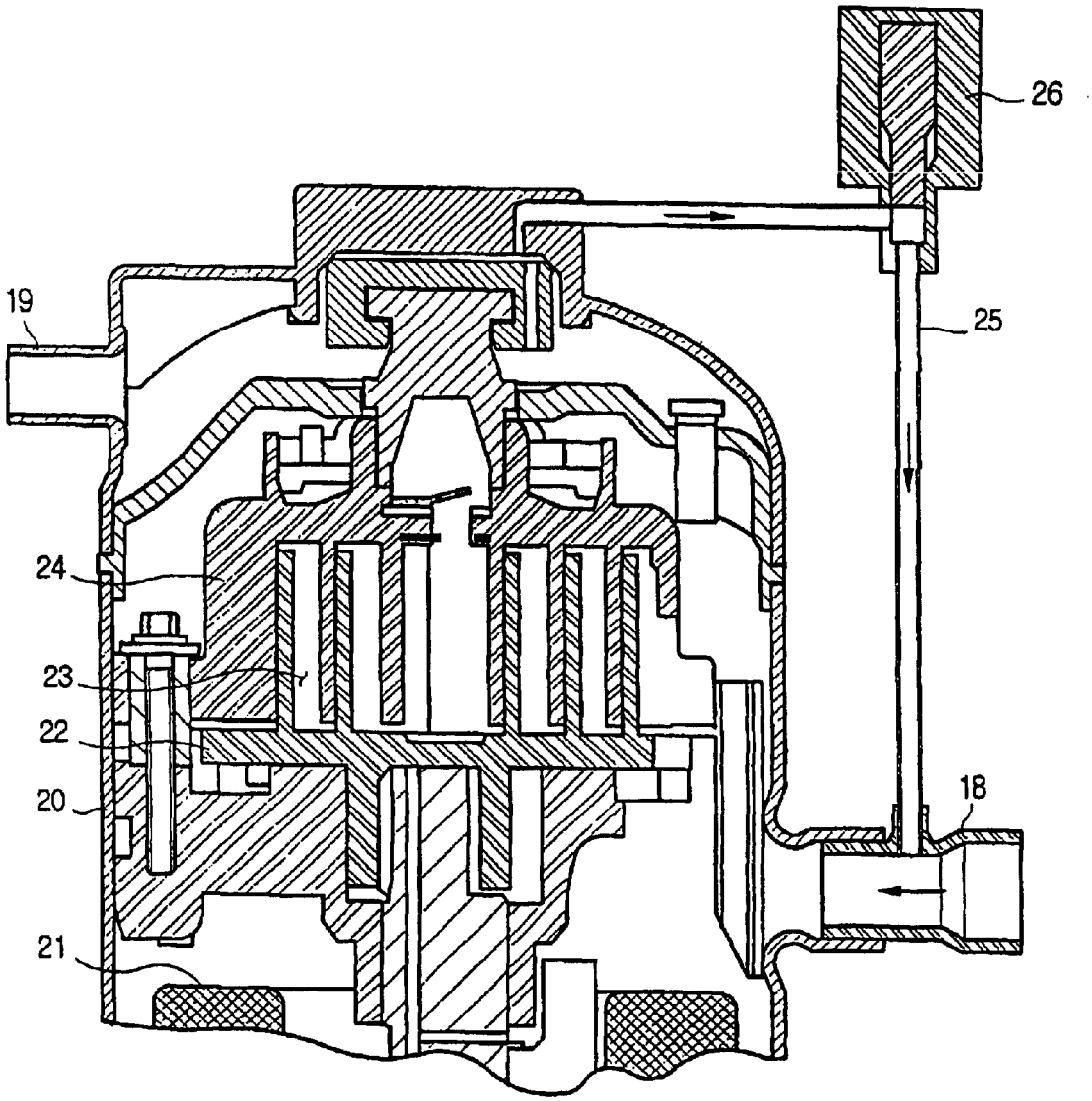
FIG. 2*b* is a view showing the unloading position thereof.

As shown in FIGS. 2*a* and 2*b*, a variable-capacity compressor controlled in a pulse width modulation manner is employed as the compressor 2. The compressor 2 includes a casing 20 having a suction port 18 and a discharge port 19, a motor 21 installed in the casing 20, a rotating scroll member 22 for rotating according to the rotation power of the motor 21, and a stationary scroll member 24 defining a compressing chamber 23 between the rotating scroll member 22 and the stationary scroll member 24. In the casing 20, a bypass pipe 25 is installed to connect the upper end of the stationary scroll member 24 and the suction port 18. A PWM valve 26 in the form of a solenoid valve is installed in the bypass pipe 25. FIG. 2*a* shows the state in which the PWM valve 26 is turned off to dose the bypass pipe 25. In this state, the compressor 2 discharges compressed refrigerant. This state is defined as a "loading state", in which the compressor 2 operates at 100% capacity. FIG. 2*b* shows the state in which the PWM valve 26 is turned on to open the bypass pipe 25. In this state, the compressor 2 does not discharge refrigerant. This state is defined as an "unloading state", in which the compressor 2 operates at 0% capacity. Regardless of the loading or unloading state, the compressor 2 is supplied with a power voltage, and the motor 21 is operated at a constant speed. If the power voltage is not supplied to the compressor 2, the motor 21 does not operate and the compressor 2 stops.

Figure 3:
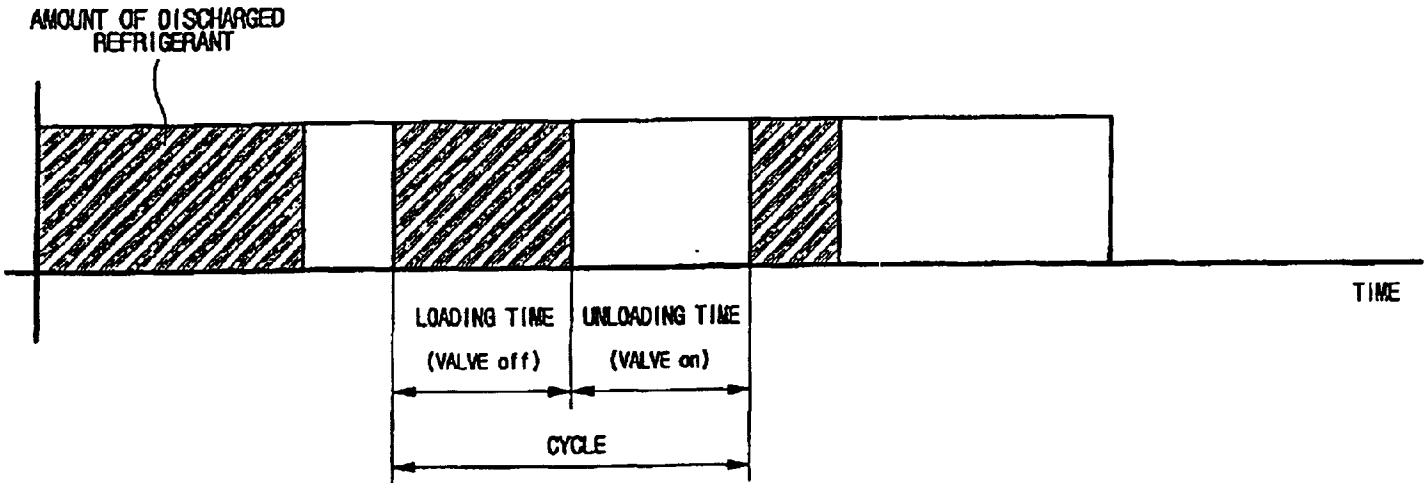
FIG. 3 is a view showing the relation between the loading or unloading state and the amount of discharged refrigerant during the operation of the compressor of this invention.

FIG. 3 is a view showing the relation between the loading or unloading state and the amount of discharged refrigerant during the operation of the compressor 2. As shown in FIG. 3, the compressor 2 repeatedly cycles through the loading and unloading states while being operated, and the loading time and the unloading time are varied according to a total required cooling capacity. As the compressor 2 discharges refrigerant in the loading time, the temperature of the evaporator 5 falls. In contrast, as the compressor 2 does not discharge refrigerant in the unloading time, the temperature of the evaporator 5 rises. In FIG. 3, the area indicated with oblique lines represents the amount of discharged refrigerant. A signal for controlling the loading time and the unloading time is defined as a duty control signal, which is generated by an outdoor control unit as will be described later.

Figure 4:
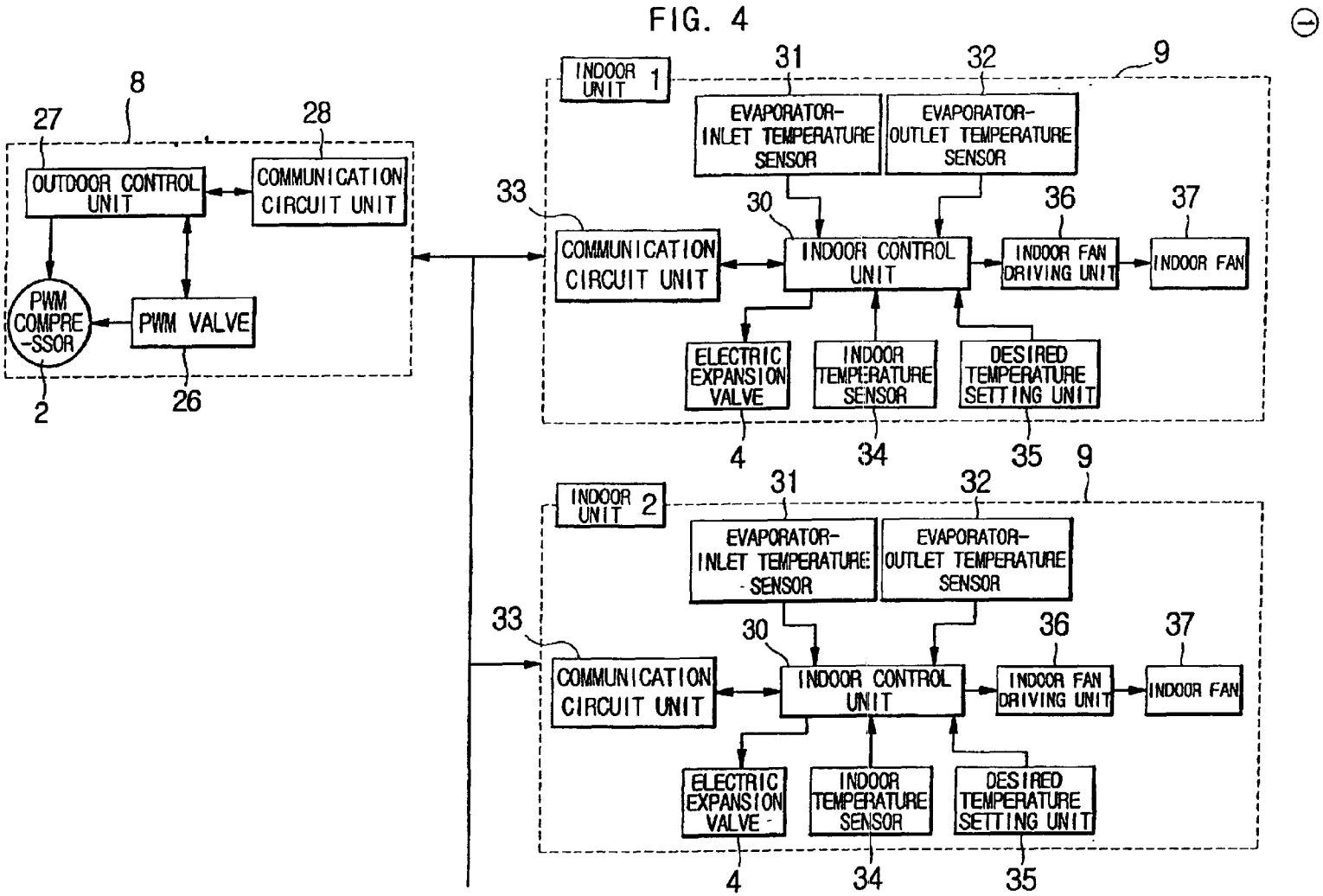
FIGS. 4*a* and 4*b* are block diagrams of an air conditioner according to a preferred embodiment of the present invention.
Figure 4:
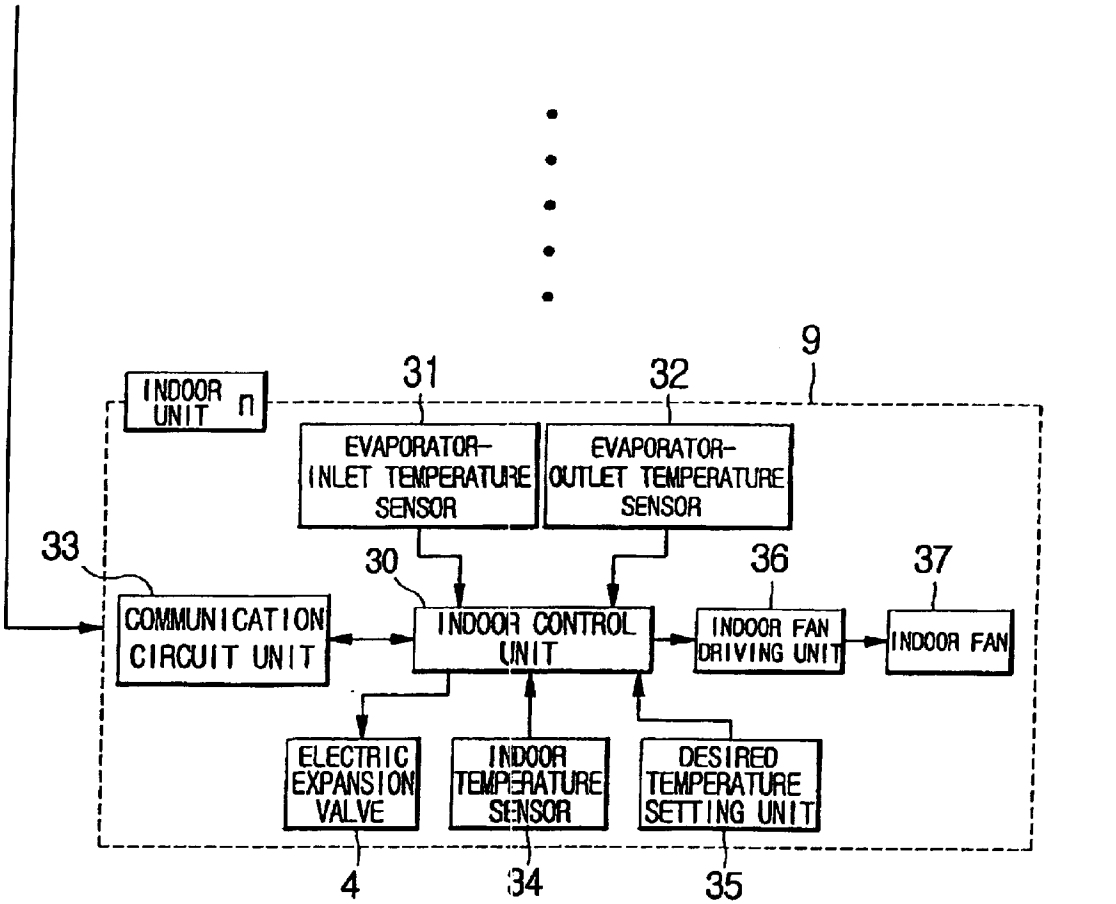

FIG. 4*a* and FIG. 4*b* are block diagrams of the air conditioner control system of a preferred embodiment of the present invention. Referring to FIGS. 4*a* and 4*b*, the outdoor unit 8 has a compressor 2 and an outdoor control unit 27, which are connected to a PWM valve 26 to transit signals. The outdoor control unit 27 is connected to an outdoor communication circuit unit 28 to transmit and receive data. Each of the indoor units 9 has an indoor control unit 30 whose input port is connected to the evaporator-inlet temperature sensor 31, the evaporator-outlet temperature sensor 32, an indoor temperature sensor 34 and a desired temperature setting unit 35. The output port of the indoor control unit 30 is connected to both the electric expansion valve 4 and an indoor fan driving unit 36. The evaporator-inlet temperature sensor 31 detects the temperature of the refrigerant flowing into the evaporator 5 through the electric expansion valve 4, while the evaporator-outlet temperature sensor 32 detects the temperature of the refrigerant flowing out of the evaporator 5. The indoor temperature sensor 34 detects the temperature of the interior of a room or an air-conditioned space, and the detected temperature information is inputted to the indoor control unit 30. If the indoor unit 9 is turned on, the indoor control unit 30 controls the indoor fan driving unit 36 to turn on the indoor fan 37, and adjusts a target opening ratio of the electric expansion valve 4 according to the degree of overheating evaluated on the basis of the outlet and inlet temperature of the evaporator 5. On the other hand, if the indoor unit 9 is turned off, the indoor control unit 30 closes the electric expansion valve 4, and controls the indoor fan driving unit 36 to turn off the indoor fan 37.

The indoor control unit 30 receives the detected indoor temperature from the indoor temperature sensor 34 and the set temperature from the desired temperature setting unit 35. The indoor control unit 30 has information about the cooling capacity of a corresponding indoor unit, and can evaluate a required cooling capacity on the basis of the difference between indoor temperature and set temperature and the cooling capacity of the corresponding indoor unit, or only the cooling capacity of the corresponding indoor unit.

The required cooling capacity evaluated by each indoor unit 9 is transmitted to the outdoor control unit 27 through the communication circuit units 29 and 33. The outdoor control unit 27 calculates a total required cooling capacity obtained by summing up the cooling capacities required by the indoor units, and then controls the compressor 2 and the PWM valve 26 on the basis of the calculated total required cooling capacity. Table 1 shows the loading time and the unloading time that are set according to a total required cooling capacity in a cycle of 20 seconds.

TABLE 1

| Loading time (sec) | Unloading time (sec) | Total required cooling capacity (Kcal/hour) | Loading time (sec) | Unloading time (sec) | Total required cooling capacity (Kcal/hour) |
|---|---|---|---|---|---|
| 20 | 0 | 148.5↑ | 10 | 10 | 69.5–77.5 |
| 18 | 2 | 135.5–148.5 | 9 | 11 | 60.5–69.5 |
| 17 | 3 | 126.5–135.5 | 8 | 12 | 51.5–60.5 |
| 16 | 4 | 118.5–126.5 | 7 | 13 | 43.5–51.5 |
| 15 | 5 | 110.5–18.5 | 6 | 14 | 34.5–43.5 |
| 14 | 6 | 102.5–110.5 | 5 | 15 | 26.5–34.5 |
| 13 | 7 | 93.5–102.5 | 4 | 16 | 17.5–26.5 |
| 12 | 8 | 85.5–93.5 | 3 | 17 | 17.5↓ |
| 11 | 9 | 77.5–85.5 | — | — | — |

The outdoor control unit 27 outputs to the PWM valve 26 a duty control signal for determining the loading time and unloading time of the compressor 2 according to the total required cooling capacity, thereby adjusting the capacity of the compressor 2. In detail, the outdoor control unit 27 checks the total required cooling capacity periodically or continuously. If the total required cooling capacity has been varied, the outdoor control unit 27 generates a duty control signal for determining the loading time and unloading time to correspond to the variation of the total required cooling capacity, and outputs the generated duty control signal to the PWM valve 26, thereby adjusting the capacity of the compressor 2. In such a case, the time when the total required cooling capacity is varied is distinguished depending on the unloading and loading states. The operation of determining the loading time according to the variation amount of the total required cooling capacity is described in detail with reference to FIGS. 5*a* and 5*b*.

Figure 5A:
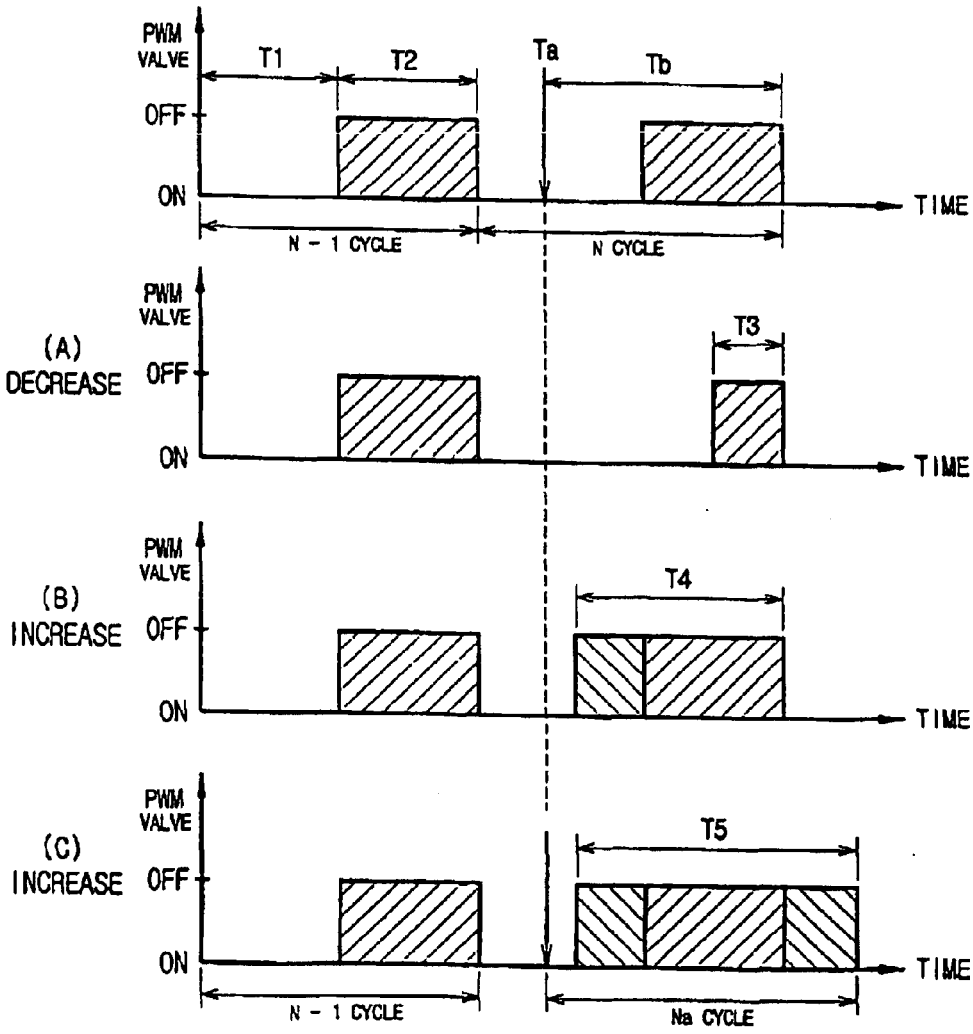
FIG. 5*a* is a view showing the control operation of the compressor when a total required cooling capacity has been varied in an unloading state.

If a total required cooling capacity has been varied in an unloading state, the outdoor control unit 27 varies a loading time as shown in FIG. 5*a*. Here, "(A)" of FIG. 5*a* represents the case where a loading time T3 in a corresponding cycle becomes shorter than a loading time T2 in the previous cycle to correspond to a decreased total required cooling capacity. "(B)" of FIG. 5*a* represents the case where a loading time T4 in a corresponding cycle becomes longer than the loading time T2 in the previous cycle to correspond to an increased total required cooling capacity. "(C)" of FIG. 5*a* represents the case where a loading time T5 becomes longer to correspond to an increased total required cooling capacity, in which a new cycle is employed because the loading time T5 is longer than a remaining time Tb at the time Ta when a total required cooling capacity is increased.

Figure 5B:
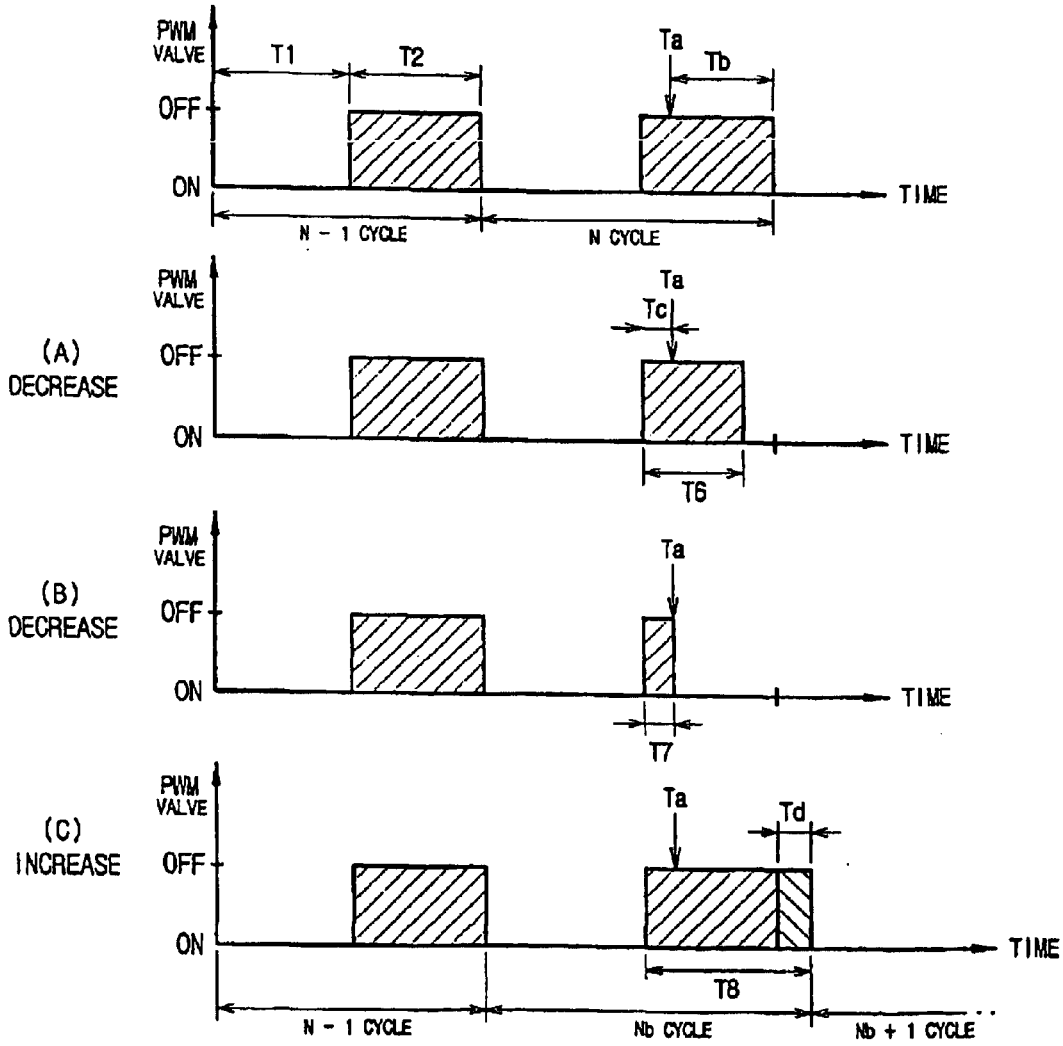
FIG. 5*b* is a view showing the control operation of the compressor when a total required cooling capacity has been varied in a loading state.

Further, if the total required cooling capacity has been varied in a loading state, the outdoor control unit 27 varies the loading time as shown in FIG. 5*b*. Here, "(A)" of FIG. 5*b* represents a case where a loading time T6 in a corresponding cycle becomes shorter than a loading time T2 in the previous cycle to correspond to a decreased total required cooling capacity. Further, "(B)" of FIG. 5*b* represents a case where a loading time T7 in a corresponding cycle becomes shorter than a loading time T2 in the previous cycle to correspond to a decreased total required cooling capacity, in which the loading time T7 is not longer than an elapsing time reaching the time Ta when the total required cooling capacity is decreased, such that the loading state is quickly switched to the unloading state and the unloading state is maintained until the corresponding cycle is over. Further, "(C)" of FIG. 5*b* represents a case where a loading time T8 to correspond to the increased total required cooling capacity is longer than the loading time T2 in the previous cycle and exceeds the loading time T2 by a loading time Td corresponding to the increased required cooling capacity, in which a current cycle Na become longer than the previous cycle N−1.

Figure 6:
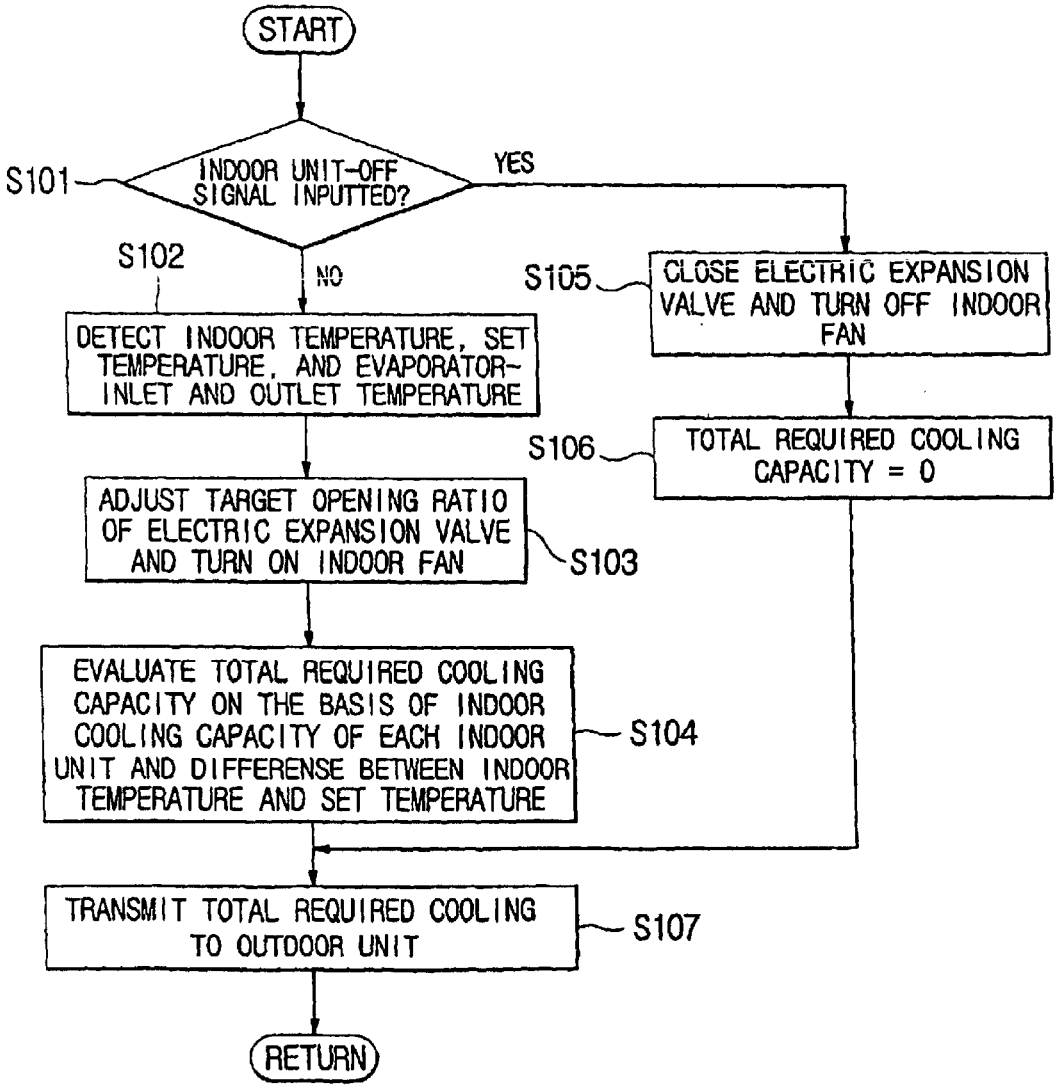
FIG. 6 is a flowchart showing the operation of an indoor unit of the air conditioner of this invention.

FIG. 6 is a flowchart of the operation of the indoor unit 9 included in the air conditioner 1 of this invention. Referring to FIG. 6, the operation of the indoor unit 9 is described in detail. First, the indoor control unit 30 determines whether an indoor unit-OFF signal has been inputted by a user at step S101. According to the determination result at step S101, if the indoor unit-OFF signal has not been inputted, the indoor control unit 30 detects the inlet and outlet temperatures of the evaporator 5 through the evaporator-inlet and outlet temperature sensors 31 and 32, and detects the indoor temperature through the indoor temperature sensor 34, and further detects a temperature set by the desired temperature setting unit 35 at step S102. Thereafter, the indoor control unit 30 evaluates the degree of overheating of the evaporator 5 on the basis of the difference between the detected inlet and outlet temperatures of the evaporator 5, and adjusts the target opening ratio of the electric expansion valve 4 on the basis of the degree of overheating, and further controls the indoor fan driving unit 36 to turn on the indoor fan 37 at step S103. Thereafter, the indoor control unit 30 evaluates the required cooling capacity of the indoor unit 9 on the basis of the cooling capacity of the indoor unit and the difference between indoor and set temperatures at step S104, and transmits the evaluated required cooling capacity to the outdoor unit 8 through the indoor communication circuit unit 33 at step S107.

On the other hand, if the indoor unit-OFF signal has been inputted at step S101, the indoor control unit 30 closes the electric expansion valve 4, and controls the indoor fan driving unit 36 to turn off the indoor fan 37 at step S105. Accordingly, the heat exchange operation of the evaporator 5 is stopped, and the pressure of the refrigerant sucked into the compressor 2 is lowered. At this time, the indoor control unit 30 evaluates the required cooling capacity of the indoor unit 9 as "0" due to the indoor unit 9 having been turned off at step S106, and transmits the evaluation value (required cooling capacity: 0) to the outdoor unit 8 at step S107.

Figure 7A:
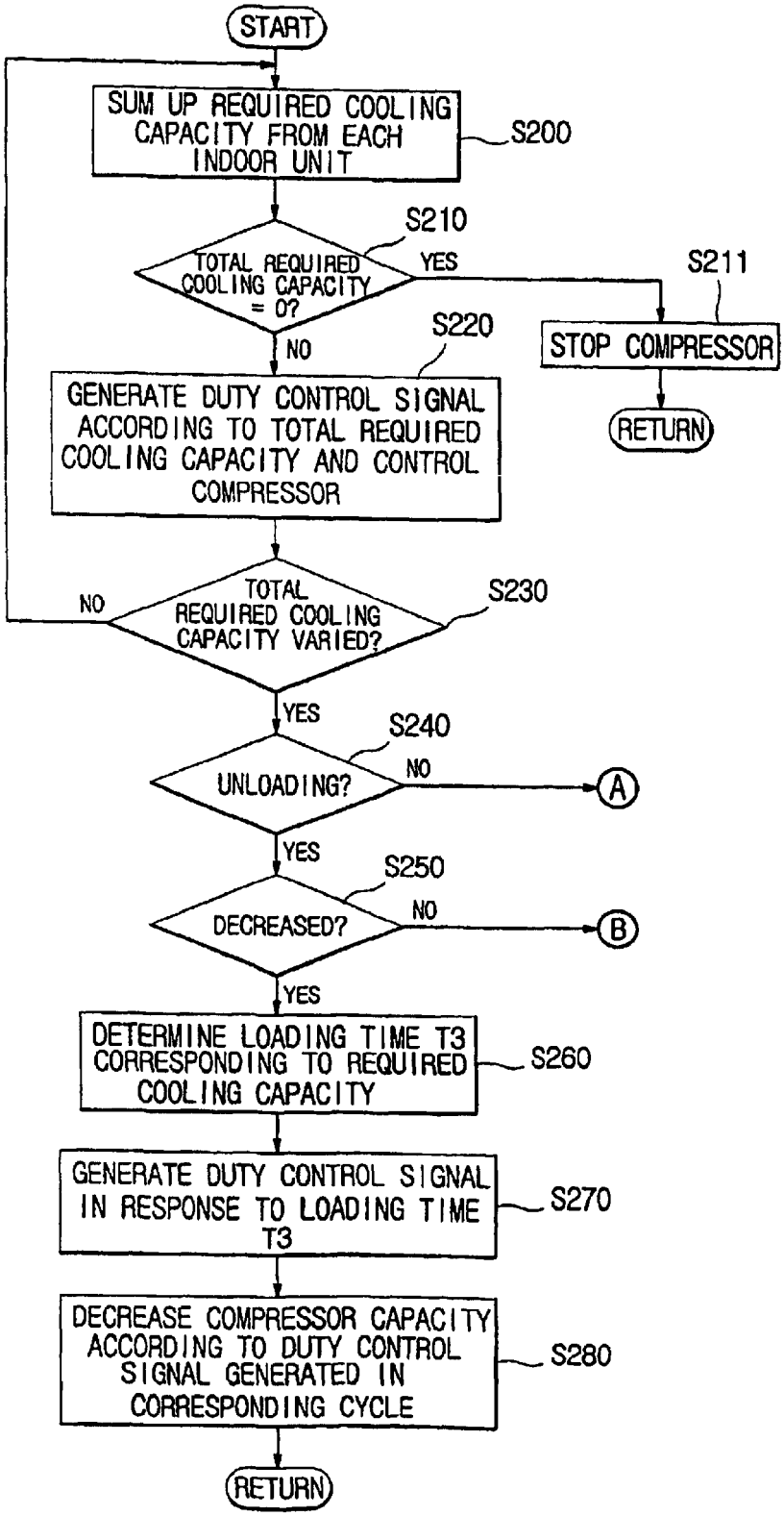
FIGS. 7*a* to 7*c* are flowcharts showing the operations of an outdoor unit of the air conditioner of this invention.
Figure 7B:
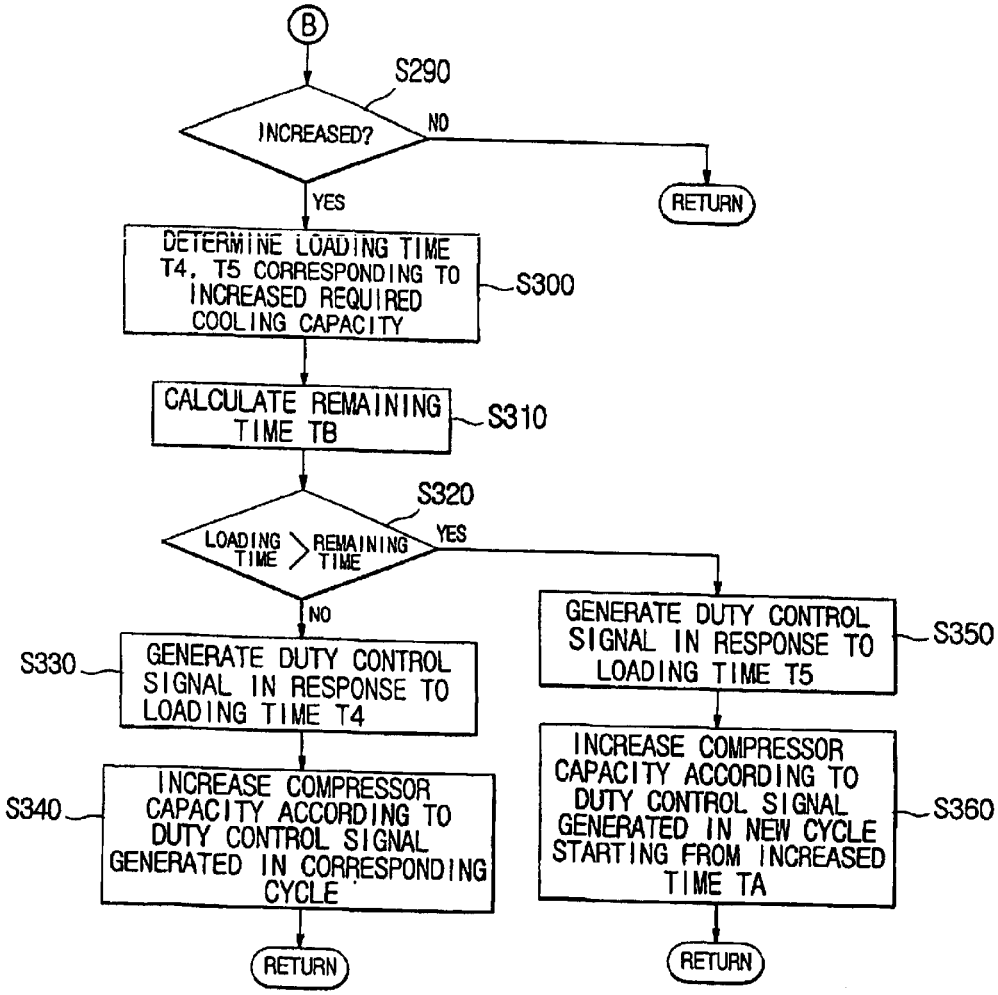
Figure 7C:
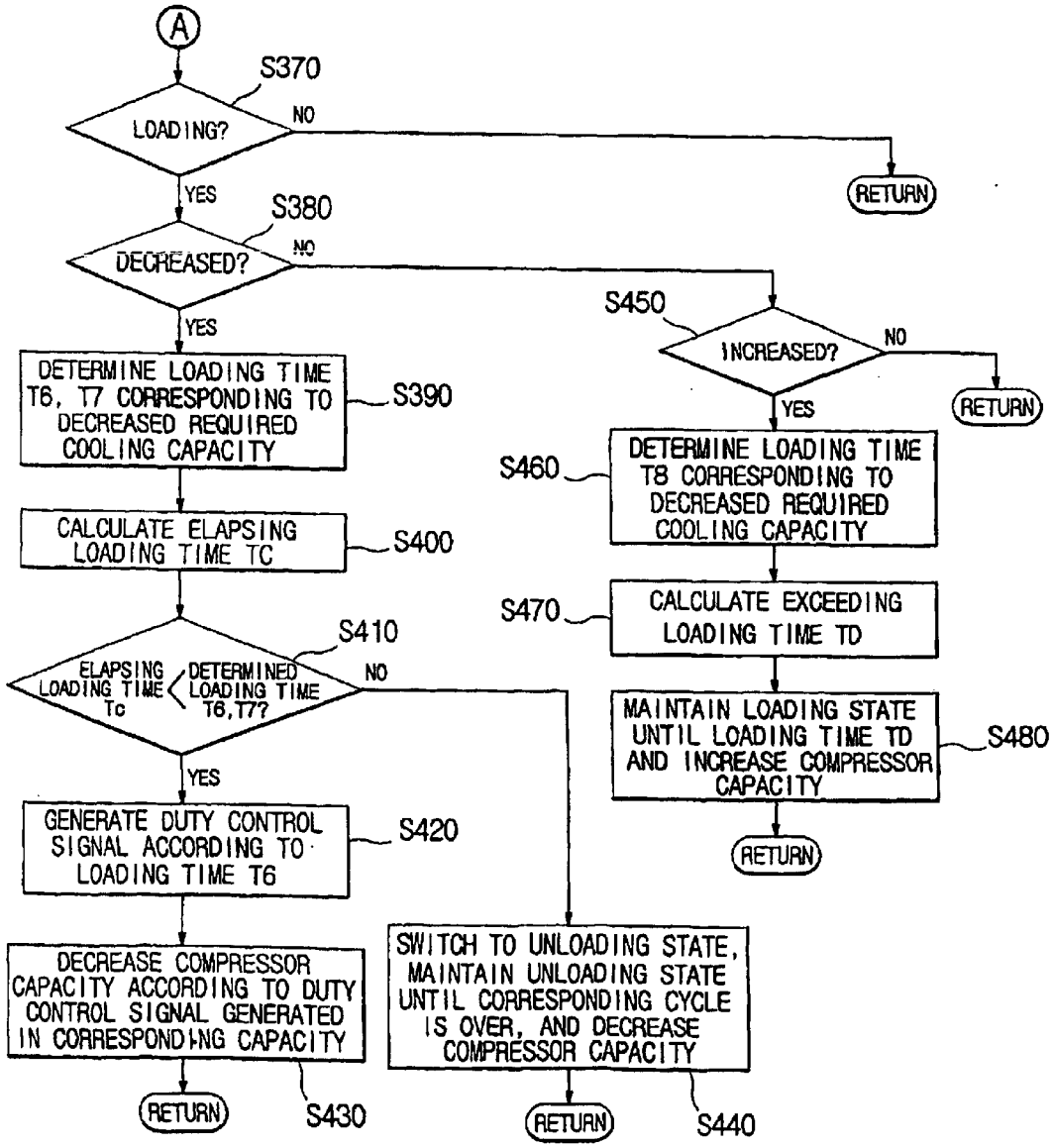
Figure 8A:
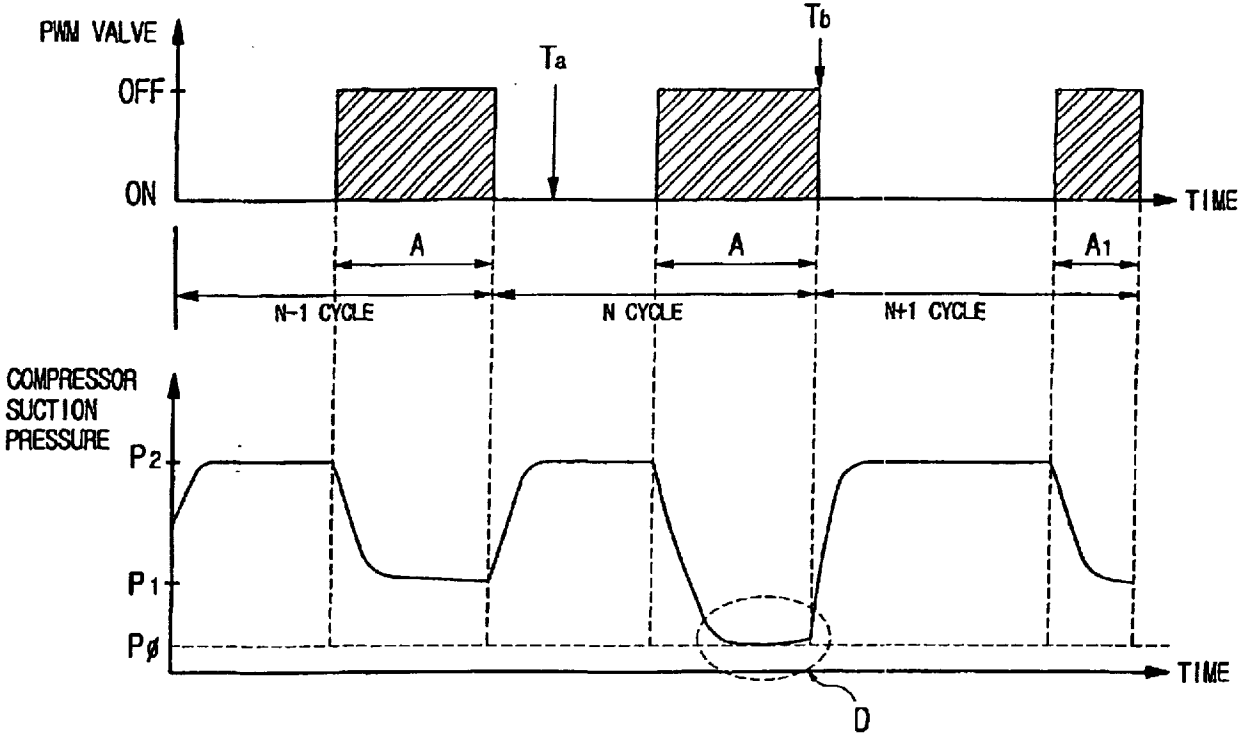
FIG. 8*a* is a view showing the control operation and suction pressure of a conventional compressor when a total required cooling capacity is decreased in the unloading state of the compressor.
Figure 8B:
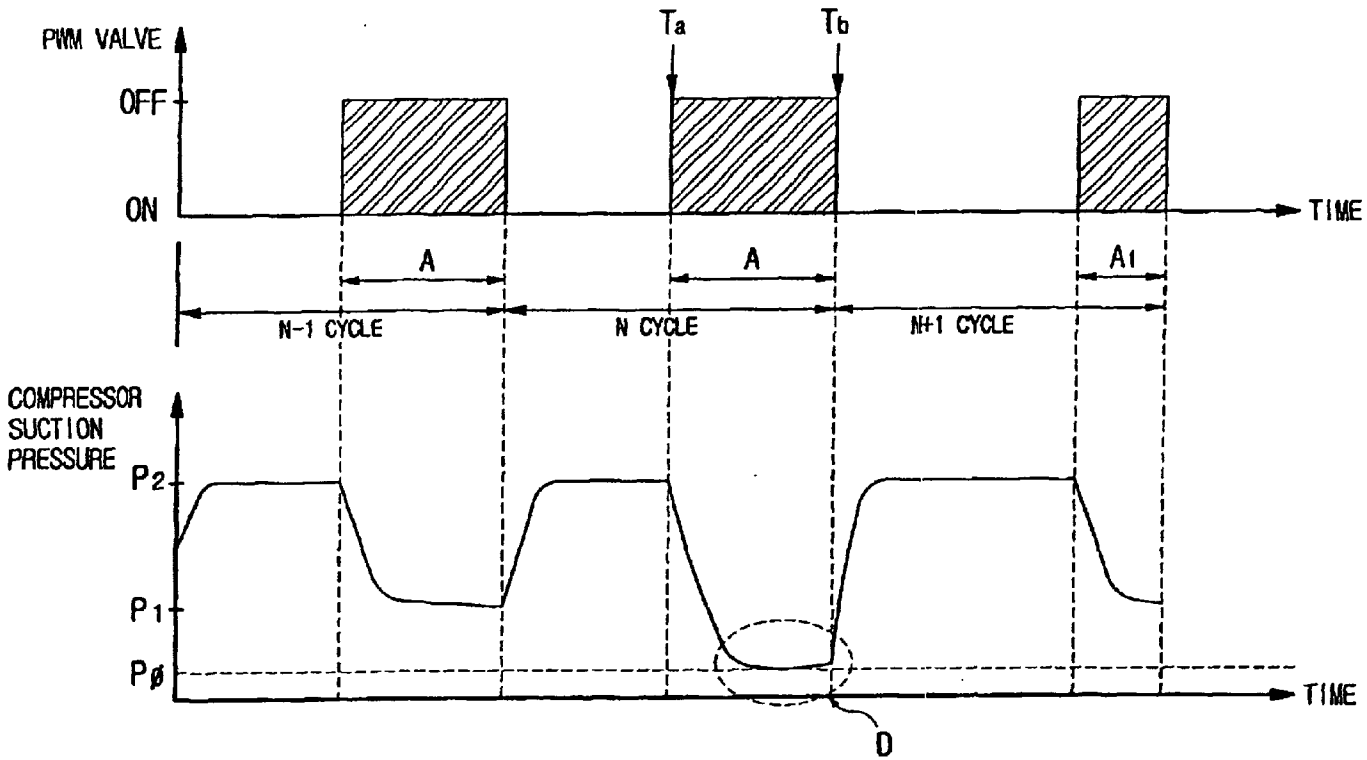
FIG. 8*b* is a view showing the control operation and suction pressure of the conventional compressor when a total required cooling capacity is decreased in the loading state of the compressor.

FIGS. 7*a* to 7*c* are flowcharts showing the operations of the outdoor unit 8 of the air conditioner 1 of the present invention. Referring to FIGS. 7*a* to 7*c*, the outdoor control unit 27 sums up the required cooling capacities from the indoor units and evaluates a total required cooling capacity at step S200. Thereafter, the outdoor control unit 27 determines whether the total required cooling capacity is "0" at step S210. If the total required cooling capacity is "0", the outdoor control unit 27 stops the compressor 2 at step S211, and returns to the initial step for repeating the process.

Further, if the total required cooling capacity is not "0" at step S210, the outdoor control unit 27 turns on the compressor 2, determines a loading time and a unloading time according to the total required cooling capacity, generates a duty control signal, and applies the duty control signal to the PWM valve 26, thereby controlling the compressor 2 at step S220.

Then, the outdoor control unit 27 determines whether the total required cooling capacity has been varied at step S220. If the total required cooling capacity is not varied at step S220, the outdoor control unit 27 proceeds to step S200 for controlling the compressor 2 continuously while maintaining the loading and unloading time of a current duty control signal.

Further, if the total required cooling capacity has been varied at step S220, the outdoor control unit 27 determines whether the time when the total required cooling capacity is varied is in the unloading or loading state of a corresponding cycle at step S240. If the total required cooling capacity has been varied in the unloading state, the outdoor control unit 27 determines whether the total required cooling capacity has been decreased in comparison with that of the previous cycle at step S250.

At step S250, if the total required cooling capacity has been decreased, the outdoor control unit 27 determines the loading time T3 according to the decreased required cooling capacity as shown in "(A)" of FIG. 5*a* at step S260. Thereafter, the outdoor control unit 27 generates a duty control signal to correspond to the loading time T3 at step S270 and applies the duty control signal to the PWM valve 26 in a corresponding cycle. At this time, the loading time T3 of the corresponding cycle becomes shorter than that of the previous cycle, thus allowing the capacity of the compressor 2 to be decreased at step S280.

On the other hand, if the total required cooling capacity has not been decreased, the outdoor control unit 27 determines whether the required cooling capacity has been increased in the unloading state at step S290. If the total required cooling capacity has not been increased, the outdoor control unit 27 returns to the initial step of the process.

If the required cooling capacity has been increased at step S290, the outdoor control unit 27 determines the loading time T4 or T5 to correspond to the increased total required cooling capacity as shown in "(B) and (C)" of FIG. 5*a* at step S300. Thereafter, the outdoor control unit 27 calculates a remaining time Tb at the increased time Ta at step S310, and determines whether the loading time T4 or T5 is longer than the calculated remaining time Tb at step S320. If the loading time T4 is not longer than the remaining time Tb, the control unit 27 generates a duty control signal corresponding to the loading time T4 at step S330, and applies the duty control signal to the PWM valve 26 in a corresponding cycle. At this time, the loading time T4 becomes longer than that of the previous cycle, and so the refrigerant amount discharged by the compressor 2 is increased, thus increasing the capacity of the compressor at step S340. Further, if the loading time T5 is longer than the remaining time Tb at step S320, the outdoor control unit 27 generates a duty control signal corresponding to the loading time T5 at step S350, applies the duty control signal to the PWM valve 26 in a new cycle starting from the increased time point Ta, thereby allowing the capacity of the compressor 2 to be increased at step S360.

On the other hand, if the total required cooling capacity has not been varied in the unloading state at step S240, the outdoor control unit 27 determines whether the total required cooling capacity has been varied in the loading state at step S370. If the total required cooling capacity has not been varied in the loading state, the outdoor control unit 27 returns to the initial step of the process.

If the total required cooling capacity has been varied in the loading state at step S370, the outdoor control unit 27 determines whether the total required cooling capacity has been decreased in comparison with that of the previous cycle at step S380. At step S380, if it is determined that the total required cooling capacity has been decreased, the outdoor control unit 27 determines a loading time T6 or T7 to correspond to the decreased total required cooling capacity as shown in "(A), (B)" of FIG. 5*b* at step S390. Then, the outdoor control unit 27 calculates a loading time Tc elapsing to the decreased time Ta from the start point of the loading at step S400, and then determines whether the loading time T6 or T7 is longer than the elapsing loading time Tc at step S410.

If the loading time T6 is longer than the elapsing loading time Tc at step S410, the outdoor control unit 27 generates a duty control signal corresponding to the loading time T6 at step S420, and applies the duty control signal to the PWM valve 26 in a corresponding cycle, such that the capacity of the compressor is decreased at step S430. However, if the loading time T7 is not longer than the elapsing loading time Tc at step S410, the outdoor control unit 27 switches the loading state to the unloading state, and then maintains the unloading state until the corresponding cycle is over at step S440.

Further, if the total required cooling capacity has not been decreased at step S380, the outdoor control unit 27 determines whether the total required cooling capacity has been increased at step S450. If the total required cooling capacity has not been increased, the outdoor control unit 27 returns to the initial step of the process. On the other hand, if the total required cooling capacity has been increased at step S450, the outdoor control unit 27 determines a loading time T8 to correspond to the increased total required cooling capacity as shown in "(C)" of FIG. 5*b* at step S460, subtracts the previous loading time T2 from the loading time T8, and then calculates a loading time Td exceeding the loading time T2 at step S470. After step S470, the outdoor control unit 27 maintains the loading state until the loading time Td, thus allowing the capacity of the compressor 2 to be increased at step S480.

INDUSTRIAL APPLICABILITY

As described above, in an air conditioner and method of controlling the same in accordance with the present invention, when a total required cooling capacity has been varied, the operation of a PWM valve is controlled by varying a loading time to correspond to the varied total required cooling capacity even before a corresponding cycle is over and, thereby, generating a duty control signal, such that the amount of refrigerant discharged by a compressor can be adjusted to correspond to the variation of the total required cooling capacity. Accordingly, in the air conditioner and method of controlling the same, when the air conditioner is applied to a multi-air conditioner system, a compressor can be operated stably regardless of sudden variations of a total required cooling capacity, thereby increasing the reliability of a compressor and eliminating the freeze-preventing operation of an indoor heat exchanger.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner, comprising:

a compressor having a capacity variable according to a duty control signal, the duty control signal controlling the compressor to undergo a loading time for maintaining a loading state in a cycle and an unloading time for maintaining an unloading state in a cycle; and a control unit for determining the loading time and the unloading time according to the variation of a total required cooling capacity to generate the duty control signal even before a corresponding cycle is over, when the total required cooling capacity has been varied in a corresponding cycle while the compressor is operated, and controlling the compressor according to the duty control signal.

2. The air conditioner as set forth in claim 1, wherein the control unit applies the duty control signal to the corresponding cycle.

3. The air conditioner as set forth in claim 1, wherein the control unit applies the duty control signal to a new cycle following the corresponding cycle.

4. The air conditioner as set forth in claim 1, wherein if the total required cooling capacity has been decreased in the unloading state of the corresponding cycle, the control unit generates a duty control signal for decreasing the loading time to correspond to the decreased total required cooling capacity, and decreases the capacity of the compressor according to the duty control signal generated in the corresponding cycle.

5. The air conditioner as set forth in claim 1, wherein if the total required cooling capacity has been increased in the unloading state of the corresponding cycle, the control unit generates a duty control signal on the basis of a remaining time of the corresponding cycle and the loading time corresponding to the increased total required cooling capacity, and increases the capacity of the compressor according to the duty control signal.

6. The air conditioner as set forth in claim 5, wherein if the loading time corresponding to the increased total required cooling capacity is not longer than the remaining time, the control unit increases the capacity of the compressor according to the duty control signal in the corresponding cycle.

7. The air conditioner as set forth in claim 5, wherein if the loading time corresponding to the increased total required cooling capacity is longer than the remaining time, the control unit increases the capacity of the compressor according to the duty control signal in a new cycle starting from the time when the total required cooling capacity is increased.

8. The air conditioner as set forth in claim 1, wherein if the total required cooling capacity has been decreased in the loading state of the corresponding cycle, the control unit generates the duty control signal on the basis of the elapsing loading time of the corresponding cycle and the loading time corresponding to the decreased total required cooling capacity, and decreases the capacity of the compressor according to the duty control signal.

9. The air conditioner as set forth in claim 8, wherein if the loading time corresponding to the decreased total required cooling capacity is longer than the elapsing loading time, the control unit decreases the capacity of the compressor according to the duty control signal generated in the corresponding cycle.

10. The air conditioner as set forth in claim 8, wherein if the loading time corresponding to the decreased total required cooling capacity is not longer than the elapsing loading time, the control unit switches its loading state to a unloading state, and maintains the unloading state until the corresponding cycle is over so as to decrease the capacity of the compressor.

11. The air conditioner as set forth in claim 1, wherein if the total required cooling capacity has been increased in the loading state of the corresponding cycle, the control unit generates a duty control signal for increasing the loading time to correspond to the increased total required cooling capacity, and maintains the loading state until the increased loading time is over so as to increase the capacity of the compressor.

12. The air conditioner as set forth in claim 1, wherein the control unit is installed in an outdoor unit connected to a group of indoor units, and determines whether the total required cooling capacity has been varied on the basis of a total required cooling capacity obtained by summing up cooling capacities required by the indoor units.

13. A method of controlling an air conditioner including a compressor with a capacity varied according to a duty control signal having a loading time and an unloading time in a corresponding cycle, comprising the steps of:

a) operating the compressor;

b) determining whether a total required cooling capacity has been varied; and c) determining a loading time and an unloading time according to the variation of the total required cooling capacity to generate a duty control signal even before a corresponding cycle is over, when the total required cooling capacity has been varied in a corresponding cycle, and controlling the compressor according to the duty control signal.

14. The method as set forth in claim 13, further comprising the step of summing up cooling capacities required by a plurality of indoor units connected to an outdoor unit, wherein the step b) is performed on the basis of the summed required cooling capacity.

15. The method as set forth in claim 13, wherein the step b) includes the step of determining whether the variation time of the total required cooling capacity is in the loading or unloading state of the corresponding cycle.

16. The method as set forth in claim 15, wherein the step b) includes the step of decreasing the capacity of the compressor according to the duty control signal generated on the basis of the loading time corresponding to the decreased required cooling capacity in the corresponding cycle if the total required cooling capacity has been decreased in the unloading state of the corresponding cycle.

17. The method as set forth in claim 15, wherein if the total required cooling capacity has been increased in the unloading state of the corresponding cycle, the step b) includes the steps of calculating the remaining time of the corresponding cycle, comparing the remaining time with the loading time corresponding to the increased total required cooling capacity, and increasing the capacity of the compressor according to the duty control signal in the corresponding cycle if the corresponding loading time is not longer than the remaining time, or increasing the capacity of the compressor according to the duty control signal in a new cycle if the corresponding loading time is longer than the remaining time.

18. The method as set forth in claim 15, wherein if the total required cooling capacity has been decreased in the loading state of the corresponding cycle, the step b) includes the steps of calculating an elapsing loading time in the corresponding cycle, comparing the remaining time with the loading time corresponding to the decreased total required cooling capacity, and decreasing the capacity of the compressor according to the duty control signal in the corresponding cycle if the corresponding loading time is longer than the elapsing loading time, or switching the loading state to the unloading state and maintaining the unloading state until the corresponding cycle is over so as to decrease the capacity of the compressor if the corresponding loading time is not longer than the elapsing loading time.

19. The method as set forth in claim 13, wherein if the total required cooling capacity has been increased in the loading state of the corresponding cycle, the step b) includes the steps of determining the loading time to correspond to the increased total required cooling capacity, calculating a loading time exceeding a previous loading time in the determined loading time, and maintaining the loading state until the exceeding loading time is over so as to increase the capacity of the compressor.

* * * * *